United States Patent [19]

Ikeda

[11] Patent Number: 4,713,886

[45] Date of Patent: Dec. 22, 1987

[54] PIERCING TOOL

[76] Inventor: Takashi Ikeda, 2-19-3 Shinsakae Naka Ku, Nagoya, Japan

[21] Appl. No.: 840,903

[22] Filed: Mar. 17, 1986

[51] Int. Cl.[4] ..... B26F 1/00

[52] U.S. Cl. ..... 30/366; 30/361

[58] Field of Search ..... 30/366, 367, 368, 361

[56] References Cited

U.S. PATENT DOCUMENTS 91,806 6/1869 Woodbury ..... 30/368

1,797,016 3/1931 Osborne ..... 30/368

FOREIGN PATENT DOCUMENTS 47044 3/1911 Austria ..... 30/368

*Primary Examiner*—Douglas D. Watts

*Attorney, Agent, or Firm*—Willian Brinks Olds Hofer Gilson & Lione

[57] ABSTRACT

A device for locating an object concealed behind a piercable member which is less dense than the object comprises a handle with a thin elongated needle mounted on the handle. The location of a denser object concealed behind the piercable member, such as a stud located behind drywall, is indicated by driving the needle through the drywall at selected points until a stud is struck. The locating device preferably includes a collar member surrounding and embracing the piercing end of the needle which provides lateral support for this part of the needle. The collar telescopes within a bore provided on the handle during penetration of the piercable member, with the collar being biased outboard relative to the bore to assure such lateral support at the point of needle penetration. A rigid sleeve surrounds a shank portion of the needle, with the collar member sliding along the outside of the sleeve during penetration. The sleeve lends further lateral support to the needle. The lateral support so provided enables the use of a very thin needle which readily penetrates the drywall and leaves only a tiny pin hole to repair, if necessary.

2 Claims, 3 Drawing Figures

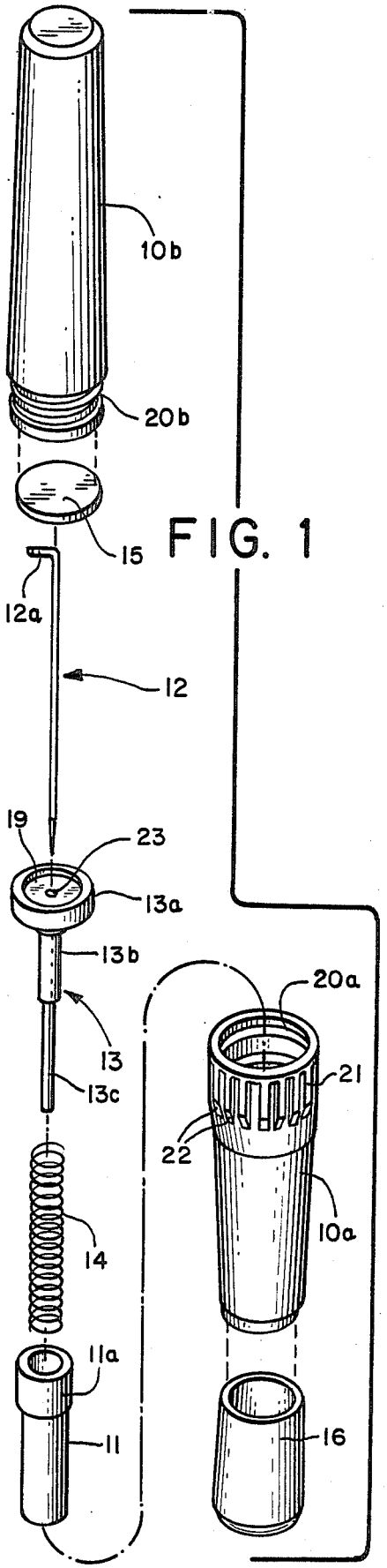
FIG. 1
FIG. 2
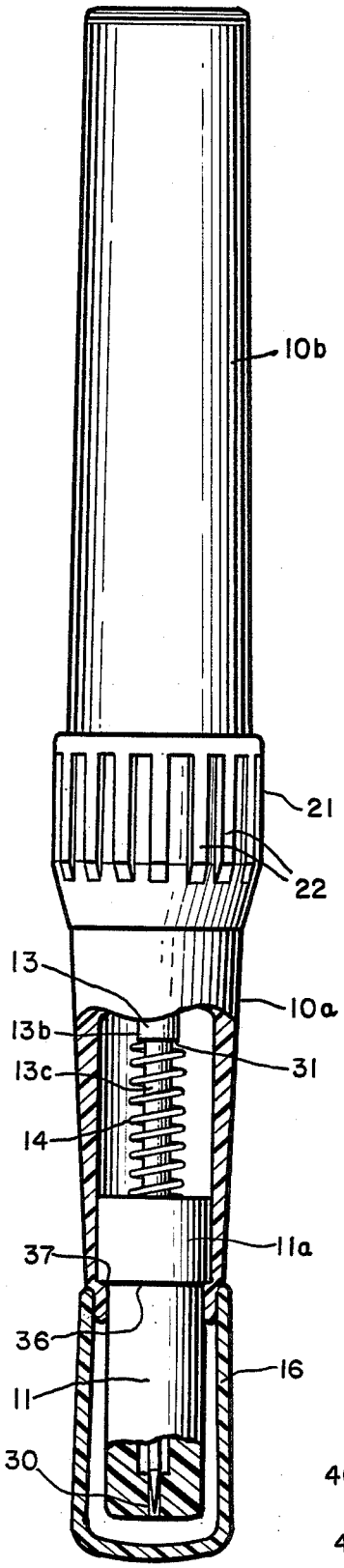
FIG. 3
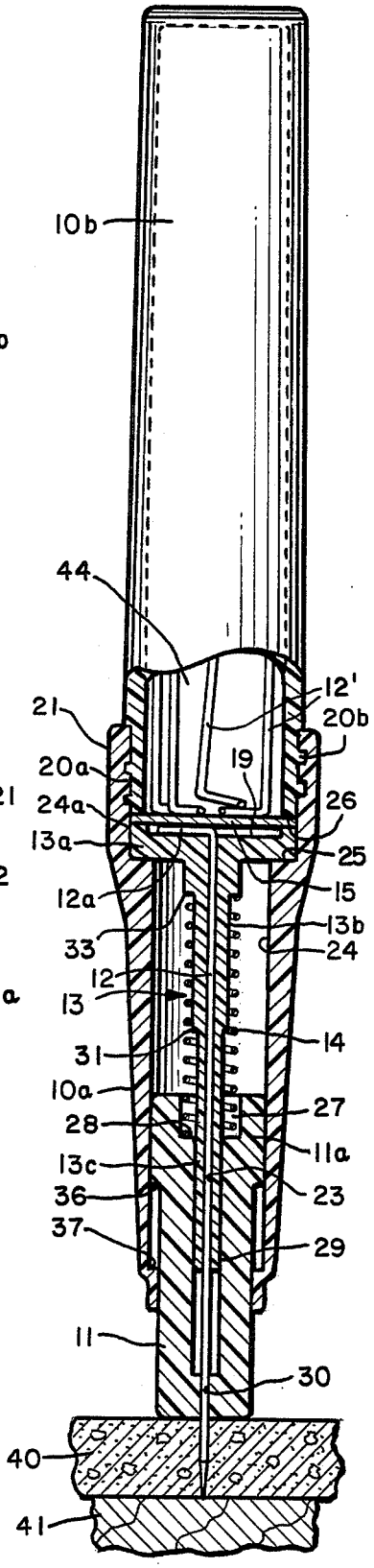

PIERCING TOOL

FIELD OF THE INVENTION

This invention is particularly related to devices for locating studs concealed behind drywall, veneer board and the like.

BACKGROUND OF THE INVENTION

While the present invention has found particular utility as a device for locating studs hidden behind drywall, veneer board and the like in a simple and expedient fashion, the concept underlying the invention, which will be elucidated hereinafter, is not necessarily so limited in application. Thus, while the invention will be described in relation to its application as a "stud finder," it will be understood that it could be generally adapted for locating an object concealed behind a piercable member which is less dense than the object. For example, a stud would be such a dense object, with the drywall constituting a less dense, piercable member.

A variety of different methods and devices have been employed in the past to locate wooden studs used in the construction of buildings, which are concealed behind drywall, veneer board, and the like. Such run the gamut from rapping on the drywall surface with one's knuckle to "hear" the location of a stud, to fairly elaborate electronic devices which indicate the presence of a stud by detection of a change in a magnetic field generated by the device.

While the knuckle-rapping location technique is very inexpensive, it is not very accurate. Electronic devices are more accurate, but they are relatively expensive. It would thus be desirable to provide a device for locating studs concealed behind drywall, veneer board and the like which is both accurate, inexpensive, and further which is readily manufactured and easy to use.

SUMMARY OF THE INVENTION

It is a principal objective of this invention to provide a device having the foregoing desirable attributes which is particularly useful for locating an object, such as a stud, concealed behind a piercable member which is less dense than the object, such as drywall. This objective is met by the present invention which comprises a handle upon which is mounted a thin elongated needle. The needle is adapted to be driven through a piercable member, e.g. drywall, by force applied to the handle, and leaves only a tiny pin hole upon removal from the piercable member. The needle is repeatedly driven through the piercable member along a line, such as a horizontal line, until the location of a denser object concealed behind the piercable member, e.g. a stud, is indicated by an increased resistance to needle insertion after passage of the needle through the less dense, piercable member.

In a preferred form of the invention, lateral support is provided for the needle during penetration of the piercable member (which is simply referred to as drywall hereinafter for ease of discussion). This includes a support which retracts along the piercing portion of the needle at the point of penetration of the piercable member, as well as a support for the shank of the needle.

In this preferred form of the invention, the handle is elongated with a tubular shape. A bore or channel is defined in a forward end section of the handle, with the needle mounted within the bore. The piercing (sharp) portion of the needle extends out of the handle bore and beyond the forward end of the handle.

A collar member is mounted within the handle bore and surrounds and embraces at least part of the piercing portion of the needle. The collar member is biased outwardly relative to the bore, and telescopes within the bore against this bias as the needle advances through the drywall. The part of the collar member which embraces the needle is pressed against the surface of the drywall by this bias, and thereby remains positioned surrounding the needle at the point of penetration of the drywall. Lateral support for the piercing portion of the needle at the point of penetration is thereby always provided. The piercing portion of the needle is thus supported against lateral deflections which might otherwise cause it to bend or break during penetration.

Lateral support for the needle shank is also additionally provided in this preferred form of the invention. This takes the form of a fixed elongated rigid sleeve which surrounds the needle shank and supports this portion of the needle against bending forces. The rigid sleeve is advantageously made to be received within an axial bore provided in the collar member, with the sleeve embraced therein.

In use, the collar member slides along the outside of the sleeve (and the inside of the handle bore) during penetration of the piercable member. The collar member thereby additionally serves to provide lateral support for the more forward part of the sleeve surrounding the shank of the needle. This presently preferred embodiment of the invention thus provides lateral support for a substantial portion of the entire length of the needle to protect it from bending or breakage. This enables the use of a small gauge needle which only leaves a small pin hole to mark its passage through the drywall. Such pin holes are readily covered by paint, if necessary. A thin needle is also more readily driven through the drywall, with minimal force required to do so.

It will be additionally noted that the collar member is further designed to extend to or slightly beyond the sharpened needle end to protect the user against accidental puncturing from the needle. An inboard stop is also provided for the collar member which serves to indicate that the needle has completely passed through the drywall (the drywall having a thickness which is less than the longitudinal length of the portion of the needle which can penetrate it).

The aforementioned tubular-shaped handle is also advantageously formed with front and back sections which are detachably fixed together, such as by a threaded coupling at the middle of the handle. The back section of the handle is provided with a hollow for use in storing spare needles, for example.

The presently preferred form of the invention has a small number of separate parts, and can be readily assembled from inexpensive materials. It locates studs with great accuracy, and is very easy to use.

The foregoing features and advantages of the present invention will be more readily understood upon consideration of the following detailed description of the invention taken in conjunction with the accompanying drawings, in which:

BRIEF DESCRIPTION OF THE DRAWINGS

FIG. 1 is an exploded perspective view of a device made in accordance with the present invention;

FIG. 2 is an enlarged elevational view of the device of FIG. 1 in assembled form, with portions broken away for detail; and FIG. 3 is a view similar to that of FIG. 2 showing the device in use, with the forward half of the device shown in cross-section, and a portion of the rearward half partially broken away for detail.

DETAILED DESCRIPTION OF THE INVENTION

The embodiment of the invention described herein has been particularly adapted for use in locating wooden studs hidden behind drywall, veneer board, etc. As previously noted, although the invention is of great utility in the described environment, it will be understood that the invention is not necessarily so limited in its application. That is, there may be other adaptations of this invention where it can be used to find an object concealed behind a piercable member which is less dense than the object, other than the instant "stud finder" application.

Referring to FIG. 1, the components of the device comprise a handle having a forward section 10*a* and a rearward section 10*b*, a collar member 11, a thin elongated needle 12, a sleeve member 13 (within which a portion of the needle 12 is received and which in turn is received within the collar member 11), a spring 14 which biases the collar member 11, and a coin 15 which serves as an end stop for the needle 12 and sleeve member 13. A cap 16 is additionally provided which is received in a friction fit on the outboard end of the forward handle section 10*a*.

It will be understood that the terms forward, rearward, front, back and the like are made with reference to the portion of the device containing the needle (and which is pressed against the piercable member in use) as the forward or front end.

Both of the handle sections 10*a* and 10*b* are tubular-shaped. They are joined together at about the middle of the device through the use of a threaded coupling indicated at 20*a*, 20*b*. Forward handle section 10*a* is provided with a slightly raised area 21 which has a plurality of axially extending ridges 22 formed thereon which extend around the entire circumference of the raised area 21. This provides a good gripping surface for use of the device, as well as for threading and unthreading the forward and rearward sections 10*a*, 10*b* of the handle.

The thin elongated needle 12 used in this embodiment is about three inches in longitudinal length, with a one-quarter inch L-shaped bend 12*a* formed at the base of the shank portion of the needle. A sharpened point is provided on the opposite end of the needle, which is referred to herein as the piercing portion of the needle. The needle 12 is made out of a circular cross-section stainless steel wire of a fairly small diameter, on the order of 0.7 millimeters.

The needle 12 is received within the sleeve member 13 which is comprised of a disc-shaped base 13*a* and first and second concentrically arranged tubular-shaped sleeve elements 13*b* and 13*c*, respectively. It will be noted that while the elements of the sleeve member 13 have been separately described, they form an integrated whole.

A needle bore 23 extends through the base and sleeve elements along the axis of the sleeve member 13. The needle 12 is received within this needle bore 23, with about two-thirds of the needle (including the shank portion) being surrounded by the sleeve member 13. The sleeve member 13 is substantially rigid, and serves to support this portion of the thin needle against lateral bending forces. The remaining approximately one-third of the needle (which includes the piercing portion) extends beyond the outboard end of the sleeve member 13.

When the needle 12 is assembled with the sleeve member 13, the bend 12*a* abuts against the back of the base 13*a* and sits in a well 19 formed therein. The well 19 is approximately the depth of the needle diameter.

As shown in FIG. 3, the front of the base 13*a* is received within a widened interior portion 24*a* of a circular cross-section bore or channel 24 which extends through the entire forward handle section 10*a*. This widened portion 24*a* of the channel 24 ends in an interior shoulder 25 against which the front of the base 13*a* abuts upon assembly of the device. The needle 12 and sleeve member 13 are kept in place against this shoulder 25 through the use of the coin 15, which is approximately the same diameter as that of the base 13*a*. The coin 15 is placed over the back of the base 13*a* and the needle bend 12*a*, and then fixed in position by the threaded engagement of the two handle sections 10*a*, 10*b*. A lip 26 surrounding the inboard end of the rearward handle section 10*b* presses the coin 15 against the base and the base 13*a* against the interior shoulder 25.

A retractable collar member 11 provides lateral support for the part of the piercing portion of the needle 12 which it surrounds and embraces. The collar member 11 is rigid and has a cylindrical shape. A slightly enlarged rearward portion 11*a* of the collar member slides along the interior sidewall of the channel 24. A stepped bore extends along the axis of collar member 11, and comprises an inboard widened bore 27 which terminates in a shoulder 28, an elongated medial bore 29 and an end bore 30, all of which are concentric with each other. The medial bore 29 is approximately the same diameter as the sleeve member section 13*c*, the latter being received within the medial bore 29.

Shoulder 28 of the widened bore 27 engages with a shoulder 31 formed around the front end of the sleeve section 13*b* which serves as an end stop for rearward movement of the collar member 11. The spring 14 is mounted concentric with the sleeve member sections 13*b* and 13*c*, with one end of the spring abutting against a shoulder 33 formed on the sleeve section 13*b*, and the other end of the spring being received within the widened bore 27 and abutting against the shoulder 28. The spring 14 biases the collar member 11 outboard relative to the channel 24. Collar member 11 is retained within the channel 24 by a shoulder 36 formed on the rearward portion 11*a* of the collar member 11 which engages with a shoulder 37 extending within the channel 24 adjacent the outboard end of the channel.

The diameter of the bore 30 is within a close tolerance to the diameter of the needle 12. By this arrangement, the piercing portion of the needle 12 is fairly closely embraced by the walls defining the collar bore 30. This provides good lateral support to this portion of the needle during penetration of a piercable material, such as drywall 40. The lateral support provided by the walls of the bore 30 always remains at the point where the needle 12 penetrates the drywall 40. That is, as the needle 12 initially penetrates the drywall wall 40 and progresses through the drywall material, the collar member 11 slides or retracts along the length of the needle, but always continues to support that part of the needle 12 which is about to advance into the material 40. The part of the needle which has already advanced into the material 40 is, of course, laterally supported by the material itself.

Collar member 11 telescopes within the channel 24 as the needle 12 advances into the drywall 40, until it engages with the shoulder 31. The bias of the spring 14 assures that the outboard end of the collar member 11 remains against the face of the drywall 40, thus assuring continued lateral support of the needle piercing portion by the walls of the end bore 30. The shoulder 31 serves as a stop to the inboard movement or retraction of the collar member 11. This indicates to the user that the needle 12 has passed completely through the drywall 40 without hitting a stud 41, assuming the distance of travel of the needle 12 has not already apprised the user of this fact. It will of course be apparent that the needle 12 is appropriately sized in length to pass completely through the drywall 40 to which it is applied.

Medial bore 29 of the collar member 11 also serves to provide lateral support for the sleeve member section 13*c* which is received therein. This serves to further protect the needle 12 against bending or breakage from lateral bending forces.

From the foregoing, it will thus be seen that the needle 12 is laterally supported for a substantial portion of its entire length. A very thin needle can therefore be employed with this device which leaves a barely perceptible mark on the drywall from needle penetration. Use of such a thin needle also requires little force to drive it through the drywall 40. It is therefore very simple to progress in a horizontal line across a given area of drywall 40 making small pinprick size penetrations until a relatively impenetrable or dense material, such as a stud 41, is encountered. Further penetrations can then precisely define the lateral extremities of the stud 41 so that its center or middle can be fairly accurately estimated.

It will be noted that the collar member 11 is advantageously made to extend to or slightly beyond the sharpened end of the needle 12. This protects the user against accidental puncture wounds when handling the device.

Rearward handle section 10*b* is also advantageously made with a hollow 44 formed therein. The hollow 44 has an open end defined by the lip 26, and is useful for storing spare needles 12′ therein.

Thus, while the invention has been described in connection with a certain presently preferred embodiment, those skilled in the art will recognize many modifications of structure, arrangement, portions, elements, materials and components which can be used in the practice of the invention without departing from the principles of this invention.

What is claimed is:

1. A device for locating an object concealed behind a piercable member which is less resistant to piercing than the concealed object, comprising:

a handle, said handle being elongated and tubular in shape with a forward portion and a rearward portion, said handle having a bore defined therein by an interior sidewall with said bore extending through said forward handle portion, an elongated needle mounted on said handle, said needle being adapted to be driven through the piercable member by force applied to said handle, said needle being mounted within said handle bore and having a piercing portion with a sharpened end extending beyond said handle, and a shank portion, a collar member having a portion surrounding and embracing at least a part of said needle piercing portion, said collar member being mounted to telescope within said handle bore during penetration of the piercable member, said collar member having a cylindrical shape with a bore extending therethrough along its longitudinal axis, a rigid sleeve surrounding said needle shank portion, said needle piercing portion and a portion of said sleeve being received within said collar member bore with said sleeve embraced therein, said collar member sliding along the outside of said sleeve and the inside of said handle bore during penetration of the piercable member by said needle, a spring mounted concentric with said sleeve with one end of said spring engaged with said sleeve and another end of said spring engaged with said collar member for biasing said collar member outboard relative to said handle bore such that said collar member portion is proximate said sharpened needle end upon initial penetration of the piercable member by said needle, said forward and rearward portions of said handle being detachably fixed together, said sleeve including a laterally widened base portion which engages with a shoulder extending within said handle bore to limit outboard movement of said sleeve, said needle shank portion having its inboard end bent normal to the needle axis, said bent needle end being adjacent the inboard side of said base portion when said needle is inserted into said sleeve, and further including a coin overlying said bent needle end and said sleeve base portion, said coin forming a stop against inboard movement of said needle and base, said coin being forced against said base and said base being forced against said shoulder by a bearing surface formed on said rearward handle portion which engages said coin when said handle portions are fixed together, location of the object being indicated by an increased resistance to needle insertion after passage of the needle through the less resistant piercable member.

2. The locating device of claim 1 wherein said rearward handle portion is hollow with a closed outboard end and an open inboard end for storing said rearward handle inboard end forming said bearing surface.

* * * * *

UNITED STATES PATENT AND TRADEMARK OFFICE

CERTIFICATE OF CORRECTION

PATENT NO. : 4,713,886

DATED : Dec. 22, 1987

INVENTOR(S) : Takashi Ikeda

It is certified that error appears in the above-identified patent and that said Letters Patent is hereby corrected as shown below:

IN THE CLAIMS

In Claim 2 (column 6, line 56), after the words "for storing", please insert:

--spare needles within said hollow, a lip surrounding--.

Signed and Sealed this

Eighth Day of November, 1988

*Attest:*

DONALD J. QUIGG

*Attesting Officer*

*Commissioner of Patents and Trademarks*